US010443183B2

(12) United States Patent
Worley

(10) Patent No.: US 10,443,183 B2
(45) Date of Patent: Oct. 15, 2019

(54) DRYER APPLIANCE AND RELATED METHODS

(71) Applicant: Haier US Appliance Solutions, Inc., Wilmington, DE (US)

(72) Inventor: Mark William Thomas Worley, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 257 days.

(21) Appl. No.: 15/463,608

(22) Filed: Mar. 20, 2017

(65) Prior Publication Data

US 2018/0266042 A1 Sep. 20, 2018

(51) Int. Cl.

| | |
|---|---|
| ***F26B 21/00*** | (2006.01) |
| ***D06F 58/28*** | (2006.01) |
| *D06F 58/08* | (2006.01) |

(52) U.S. Cl.

CPC ..... *D06F 58/28* (2013.01); *D06F 58/08* (2013.01); *D06F 2058/2858* (2013.01); *D06F 2058/2887* (2013.01)

(58) Field of Classification Search

CPC ..... D06F 58/28; D06F 2058/2854; D06F 2058/2858; D06F 2058/2887

USPC ..... 34/524, 525, 108, 126

See application file for complete search history.

(56) References Cited

U.S. PATENT DOCUMENTS

| | | | | |
|---|---|---|---|---|
| 6,996,920 | B2 | 2/2006 | Bang et al. | |
| 9,334,603 | B2 | 5/2016 | Oak et al. | |
| 2010/0132219 | A1 | 6/2010 | Etemad et al. | |
| 2012/0095606 | A1* | 4/2012 | Besore | A47L 15/0047 700/291 |
| 2014/0298676 | A1* | 10/2014 | Oak | D06F 58/04 34/499 |
| 2017/0085390 | A1* | 3/2017 | Belveal | H04W 4/70 |
| 2017/0175321 | A1* | 6/2017 | Krieger | A47L 15/4259 |
| 2017/0284013 | A1* | 10/2017 | Peterson | D06F 58/08 |

* cited by examiner

*Primary Examiner* — John P McCormack
(74) *Attorney, Agent, or Firm* — Dority & Manning, P.A.

(57) ABSTRACT

A method of detecting and mitigating unintended circumstances involving a dryer appliance includes detecting a disabled drive belt of the dryer appliance and detecting at least one additional condition. The method further includes providing a notification to a user when both the disabled drive belt and the additional condition are detected and modifying an operation of the dryer appliance when both the disabled drive belt and the additional condition are detected.

17 Claims, 4 Drawing Sheets

DRYER APPLIANCE AND RELATED METHODS

FIELD OF THE INVENTION

The present subject matter relates generally to dryer appliances, and more particularly to a dryer appliance operable to detect, mitigate, and/or notify a user of an unintended circumstance involving the dryer appliance, and related methods.

BACKGROUND OF THE INVENTION

Dryer appliances generally include a cabinet with a drum mounted therein. In some dryer appliances, a motor rotates the drum during operation of the dryer appliance, e.g., to tumble articles located within a chamber defined by the drum. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance.

The motor of the dryer appliance is generally in mechanical communication with the drum of the dryer appliance via a drive belt, such that in operation, the motor rotates the drive belt, and the drive belt in turn transfers this rotation to the drum. Rotating the drum may cause articles to be dried within the drum to tumble within the drum, increasing the contact area of the articles with the heated air passing through the chamber. Increasing the contact area of the articles with the heated air passing through the chamber may provide decreased drying time for the articles and more even thermal distribution across the articles.

However, drive belts may eventually wear out and/or become disabled, e.g., become misaligned or break. For example, a driver belt may become disabled due to a partial or complete break, such as a partial movement or loss of ribs. A disability of the drive belt, along with the presence of certain additional conditions, such as the time of day or the operating state of the dryer appliance at the time the belt breaks, may indicate an unintended circumstance involving the dryer appliance which it would be desirable to mitigate the unintended circumstance and/or notify a user of the unintended circumstance.

Accordingly, a dryer appliance with features for detecting a disabled drive belt and one or more additional conditions would be useful.

BRIEF DESCRIPTION OF THE INVENTION

A method of detecting and mitigating an unintended circumstance involving a dryer appliance includes detecting a disabled drive belt of the dryer appliance and detecting at least one additional condition. The method further includes providing a notification to a user when both the disabled drive belt and the additional condition are detected and modifying an operation of the dryer appliance when both the disabled drive belt and the additional condition are detected. Additional aspects and advantages of the invention will be set forth in part in the following description, or may be obvious from the description, or may be learned through practice of the invention.

In one aspect of the present disclosure, a method of detecting and mitigating an unintended circumstance involving a dryer appliance is provided. The method includes detecting disablement of a drive belt of the dryer appliance, detecting an additional condition, providing a notification to a user when both the drive belt disablement and the additional condition are detected, and modifying an operation of the dryer appliance when both the drive belt disablement and the additional condition are detected.

In another aspect of the present disclosure a dryer appliance is provided. The dryer appliance includes a cabinet with a drum rotationally mounted within the cabinet, the drum defining a chamber for the receipt of clothes for drying. A heater is in thermal communication with the chamber defined by the drum, and an air handler is in fluid communication with the chamber defined by the drum. The dryer appliance further includes a motor and a drive belt connected to the motor and the drum. The drive belt is configured to transfer rotational motion from the motor to the drum. The dryer appliance further includes a controller. The controller is operable to detect a drive belt disablement and to detect an additional condition. The controller is further operable to modify an operation of the dryer appliance and provide a notification to a user when both the drive belt disablement and the additional condition are detected.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
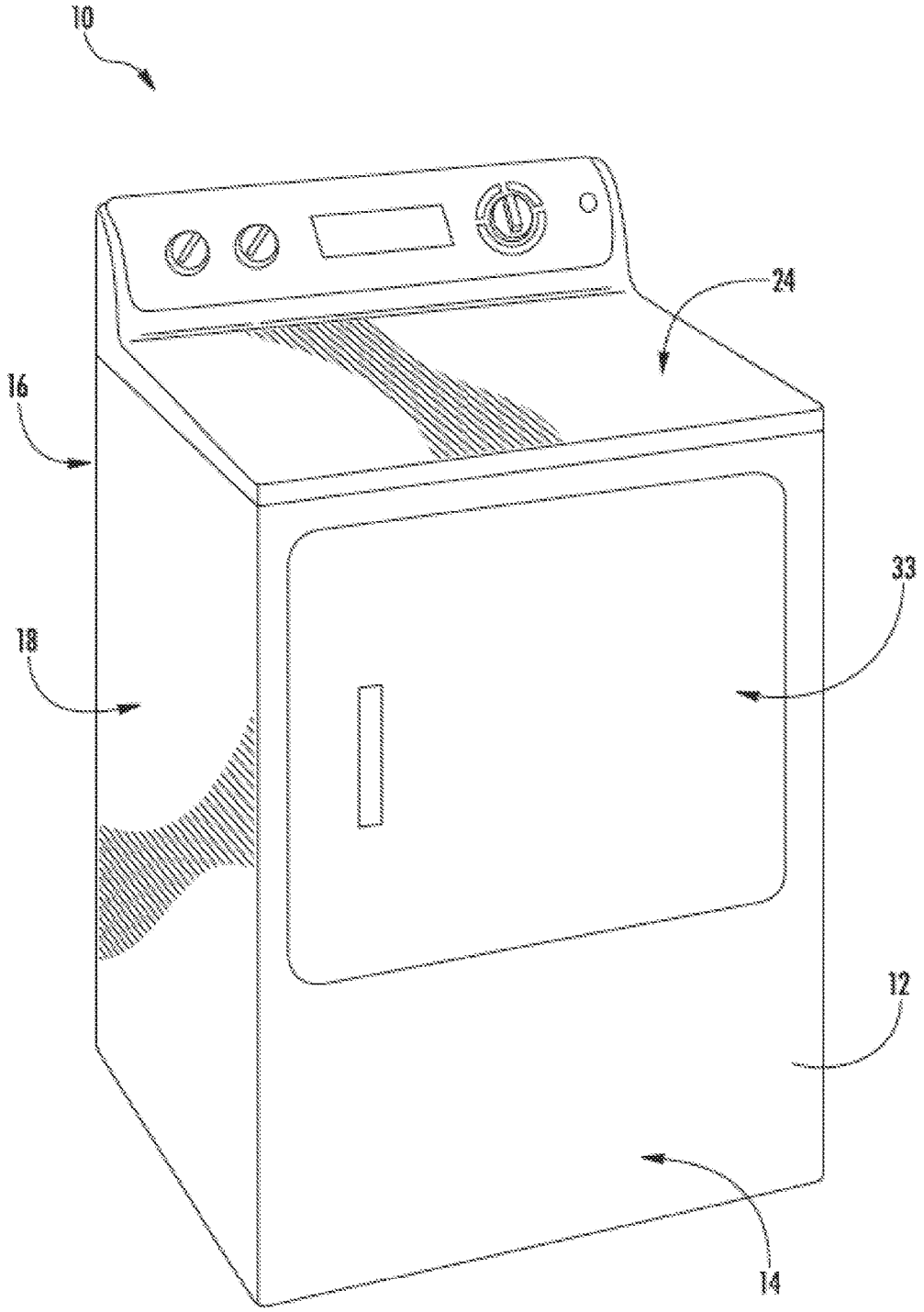
FIG. 1 provides a perspective view of a dryer appliance in accordance with an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
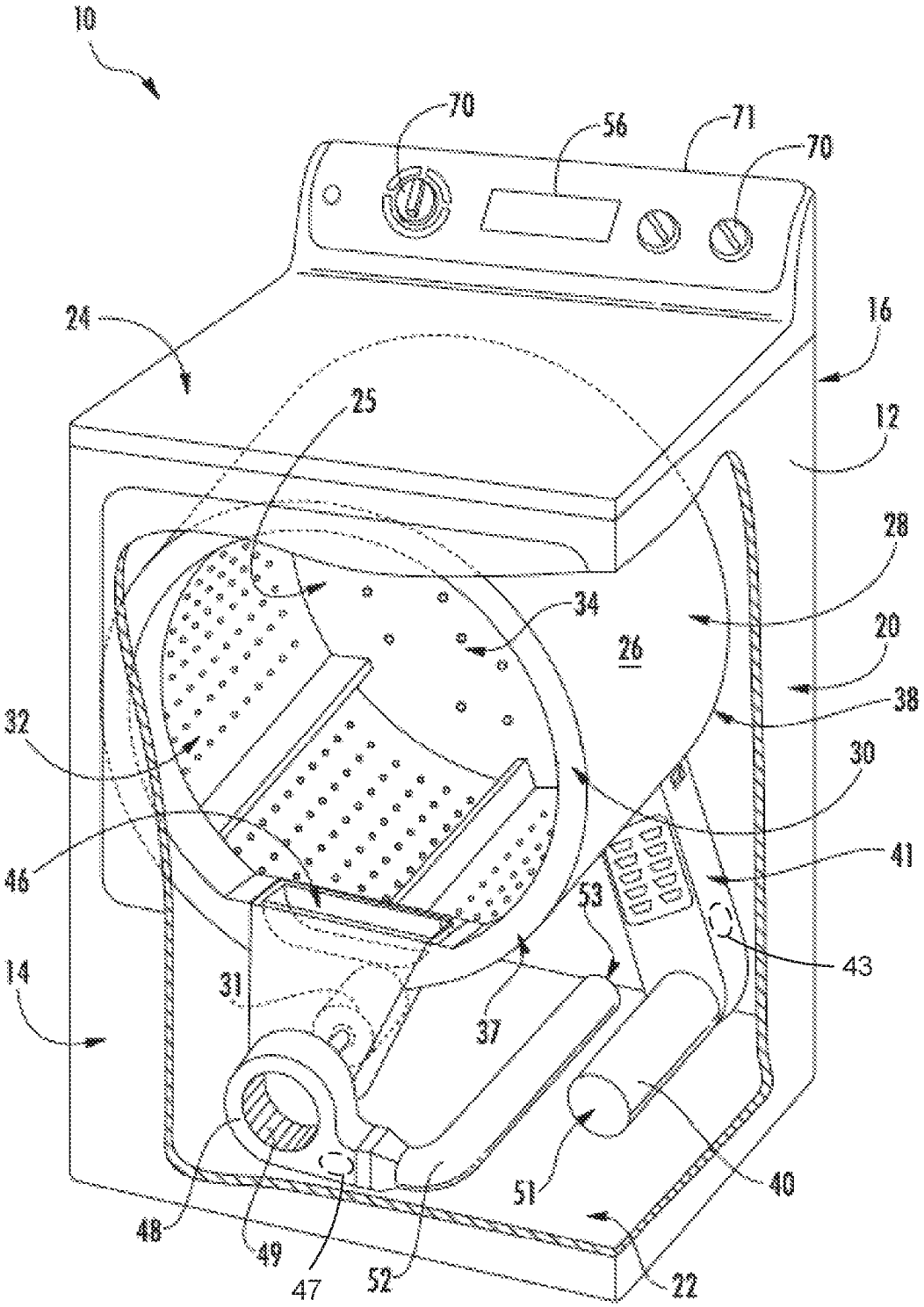
FIG. 2 provides a perspective view of the example dryer appliance of FIG. 1 with portions of a cabinet of the dryer appliance removed to reveal certain components of the dryer appliance.

Turning now to the figures, FIG. 1 illustrates a dryer appliance 10 according to an example embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis. Drum 26 defines a chamber 25 for receipt of articles of clothing for drying. Drum 26 extends between a front portion 37 and a back portion 38.

As used herein, the terms "clothing" or "laundry" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance (e.g., clothes dryer) and may include a mixture of different or similar articles of clothing of different or similar types and kinds of fabrics, textiles, garments and linens within a particular laundering process.

Figure 3:
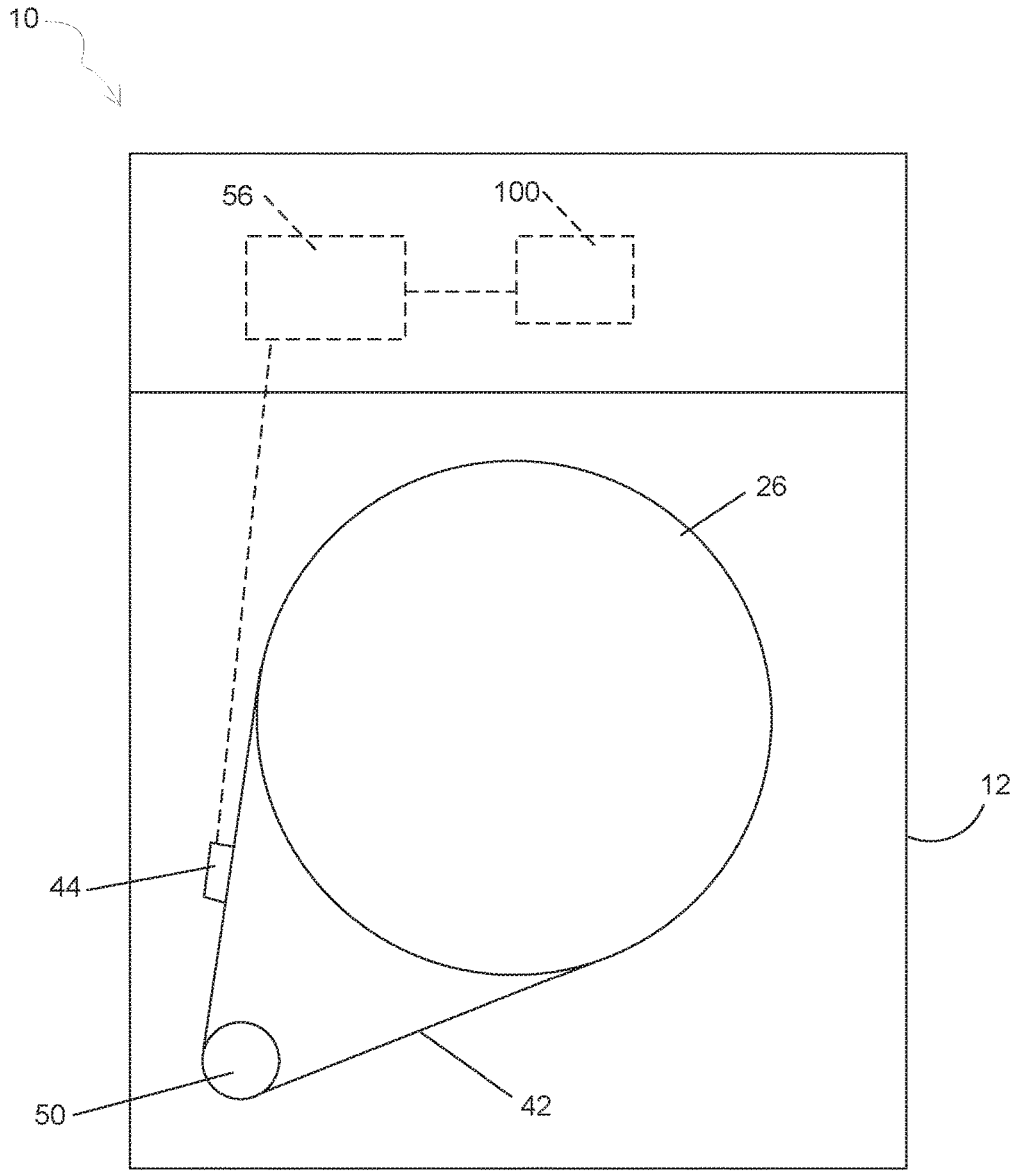
FIG. 3 provides a schematic view of portions of the example dryer appliance of FIG. 1.
Figure 4:
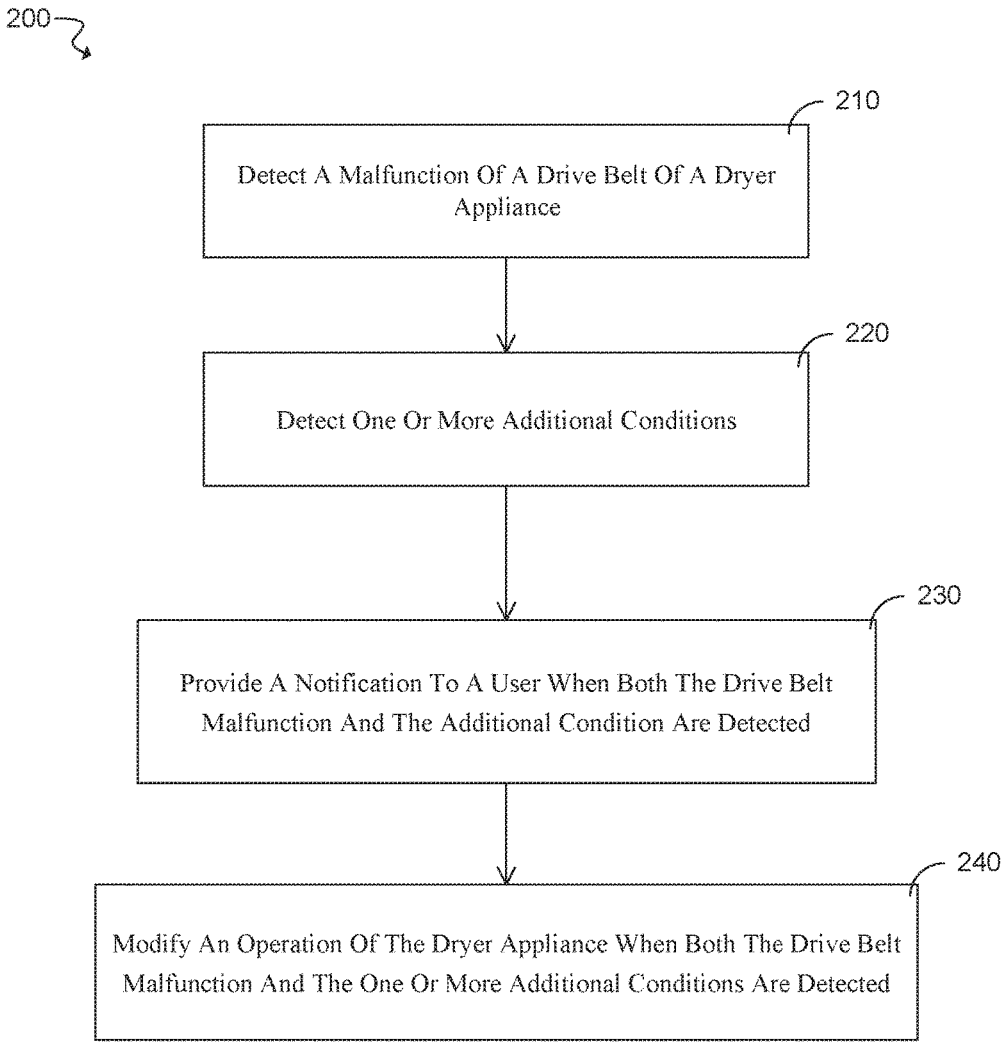
FIG. 4 is a flow chart illustrating a method of mitigating a disabled drive belt in a dryer appliance in accordance with embodiments of the present disclosure.

A motor 31 is configured for rotating drum 26 about the horizontal axis, e.g., via a pulley 50 and a belt 42 (FIG. 3). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. Drum 26 also includes a back or rear wall 34, e.g., at back portion 38 of drum 26. Rear wall 34 may be fixed or may be rotatable. A supply duct 41 is mounted to rear wall 34 and receives heated air that has been heated by a heating assembly or system 40.

Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein. In alternative example embodiments, dryer appliance 10 may include an additional motor (not shown) for rotating fan 49 of air handler 48 independently of drum 26.

Drum 26 is configured to receive heated air that has been heated by a heating assembly 40, e.g., in order to dry damp articles disposed within chamber 25 of drum 26. For example, heating assembly 40 may include a heating element (not shown), such as a gas burner, an electrical resistance heating element, or heat pump, for heating air. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air may accumulate moisture, e.g., from damp clothing disposed within chamber 25. In turn, air handler 48 draws moisture-saturated air through a screen filter (not shown) which traps lint particles. Such moisture-statured air then enters an exit duct 46 and is passed through air handler 48 to an exhaust duct 52. From exhaust duct 52, such moisture-statured air passes out of dryer appliance 10 through a vent 53 defined by cabinet 12. After the clothing articles have been dried, they are removed from the drum 26 via opening 32. A door 33 provides for closing or accessing drum 26 through opening 32. The door 33 may be movable between an open position and a closed position, the open position for access to the chamber 25 defined in the drum 26, and the closed position for sealingly enclosing the chamber 25 defined in the drum 26.

One or more selector inputs 70, such as knobs, buttons, touchscreen interfaces, etc., may be provided or mounted on a cabinet backsplash 71 and in communication with a processing device or controller 56. Signals generated in controller 56 operate motor 31 and heating assembly 40 in response to the position of selector knobs 70. Controller 56 may further be configured to receive one or more signals from sensors within the dryer appliance, such as belt switch 44, and modify the operation of the dryer appliance 10 in response to the received signal(s). In the example illustrated in FIG. 2, the inputs 70 are provided as knobs. In other embodiments, inputs 70 may be provided as a touch screen type interface.

FIG. 3 provides a simplified illustration of the dryer appliance 10. The dryer appliance 10 and cabinet 12 are represented diagrammatically, and other portions of the dryer appliance 10 are omitted in FIG. 3 solely for simplicity of illustration. In some example embodiments, such as shown in FIG. 3, pulley 50 may be connected to belt 42 and belt 42 may be connected to drum 26, e.g., belt 42 may encircle the outer cylindrical wall 28 of drum 26. Also illustrated in FIG. 3 is a belt switch 44, the belt switch 44 may be in operative communication with the belt 42 such that a loss of tension in the belt 42 will actuate the belt switch 44. Such loss of tension may result from a disablement of the belt 42, such as a break in the belt 42 or a misalignment of belt 42 with the pulley 50, another portion of the motor 31, or with the drum 26. The belt switch 44 may be in operative communication with the controller 56, and the belt switch 44 may be configured to send a signal to the controller 56 when the belt switch 44 is actuated.

Controller 56 is a "processing device" or "controller" and may be embodied as described herein. As used herein, "processing device" or "controller" may refer to one or more microprocessors, microcontroller, application-specific integrated circuits (ASICS), or semiconductor devices and is not restricted necessarily to a single element. The controller may be programmed to operate dryer appliance 10 by executing instructions stored in memory. The controller may include, or be associated with, one or more memory elements such as for example, RAM, ROM, or electrically erasable, programmable read only memory (EEPROM). For example, the instructions may be software or any set of instructions that when executed by the processing device, cause the processing device to perform operations. Controller 56 can include one or more processor(s) and associated memory device(s) configured to perform a variety of computer-implemented functions and/or instructions (e.g. performing the methods, steps, calculations and the like and storing relevant data as disclosed herein). It should be noted that controllers 56 as disclosed herein are capable of and may be operable to perform any methods and associated method steps as disclosed herein.

The dryer appliance 10 may be configured to detect the presence of a communications network, such as a local area network, e.g., a home area network, and to join the network. In particular, controller 56 may include or be in communication with a network device 100 (FIG. 3) configured to facilitate the connection of the dryer appliance 10 to the network. For instance, the home appliance can be configured to communicate (e.g. using a wired or wireless connection) with a router associated with a home area network to facilitate joining the home area network. Controller 56 may further be configured to communicate with the home area network and determine whether or not a particular communications device is also connected to the home area network. For example, the communications device may be associated with a unique identifier such as a Media Access Control address (MAC address) and the controller 56 may be configured to obtain from the home area network, e.g., via the router, a list of all MAC addresses currently connected to the network and controller 56 may further be configured to determine whether the MAC address associated with the particular communications device is included on the list. Thus, exemplary methods may include connecting to a communications network, and the additional condition may include detecting that a communications device is not connected to the communications network. The communications device being separate from the dryer appliance. The communications device may be a laptop computer, smartphone, tablet, personal computer, wearable device, and/or one of various other suitable devices. In at least one example embodiment, the particular communications device may be a smartphone, and the presence or absence of the smartphone on the home area network may indicate that the owner of the smartphone is not present, e.g., the owner is not at home, such as in embodiments wherein the dryer appliance 10 is located in a home and is connected to a home area network therein. Additionally or in the alternative, the dryer appliance 10, and in particular the controller 56 thereof, may be in communication with the separate communications device, either directly or via one or more intermediate devices such as network device 100, a router, a cellular network, etc. In such embodiments, the step of determining that the communications device is not connected to the communications network is performed by identifying a communications network to which the dryer appliance 10 is connected, identifying a communications network to which the separate communications device is connected, and comparing the network identities to determine that the network identities are not the same. For example, network identities may include any unique identifier associated with a communications network such as a service set identifier (SSID), access point name (APN), Cell ID (CID), or any other suitable identifier which may be useful for distinguishing one communications network from another and/or for inferring therefrom a physical location of the separate communications device.

The network device 100 may communicate with the network through various possible communication connections and interfaces. For purposes of the description herein, possible wired or wireless communication connections and interfaces can include, but are not limited to, wireless radio, WI-FI®, BLUETOOTH®, ZIGBEE®, laser, infrared, and Ethernet type devices and interfaces.

In various embodiments, a device 44 for detecting a condition of the drive belt may be provided. For example, in some embodiments, the device 44 may be a mechanical belt switch 44. As another example, in other embodiments the device 44 may be an optical sensor 44. In exemplary embodiments wherein the device 44 is provided as a mechanical switch, the belt switch 44 may be configured to send a signal to the controller 56 when the belt switch 44 is actuated. For example, the belt switch 44 may be actuated by a loss or reduction of tension in the belt 42, whereupon the signal to the controller 56 from the belt switch may indicate a disabling of the drive belt 42. Thus, the controller 56 may be configured to receive the signal from the belt switch 44 and thereby detect disablement of the drive belt 42. In exemplary embodiments wherein the device 44 is provided as an optical sensor 44, the optical sensor 44 may be positioned such that it is occluded by the drive belt 42 when the drive belt 42 is in a desired position or alignment, such that the optical sensor 44 may detect that when the drive belt shifts to an undesired position or alignment based on increased light reaching the sensor 44. In some embodiments, the optical sensor 44 may respond to ambient light, while other embodiments may include an optical emitter (not shown) paired with the optical sensor 44 such that the drive belt 42 passes between the emitter and the sensor 44 when the belt 42 is in the desired position or alignment. In general, the optical sensor 44 may be in operative communication with the controller 56 and may further be operable to send a signal to the controller 56 upon detecting a certain level of light, the detected level of light being indicative of a disablement of the drive belt 42. Accordingly, in a similar fashion as described above with respect to the mechanical switch embodiments, the signal to the controller 56 from the optical sensor may indicate a disablement of the drive belt 42. Thus, the controller 56 may be configured to receive the signal from the optical sensor 44 and thereby detect a disablement of the drive belt 42.

Further, the dryer appliance 10 may include one or more additional sensors in operative communication with the controller 56. For example, sensors including but not limited to one or more temperature sensors, a door switch sensor, a real-time clock, and combinations thereof, may be provided in the dryer appliance 10 and in operative communication with the controller 56. Thus, the controller 56 may be configured to detect one or more additional conditions, and such additional conditions may be indicative of—an unintended circumstance involving the dryer appliance 10. In some embodiments, the one or more additional conditions may occur at or about the same time as the disablement of drive belt 42. For example, about the same time may include one or more additional conditions that occur within a measured time range before or after the drive belt is disabled The dryer appliance 10 may be configured to notify the user when the dryer appliance 10 detects a drive belt 42 disablement, e.g., when controller 56 receives a signal from belt switch 44. The dryer appliance 10 may further be configured to provide a higher-priority notification to the user when the unintended circumstance is detected, e.g., when drive belt 42 disablement and at least one additional condition are detected. In some embodiments, the dryer appliance 10 may be configured to provide only the higher-priority notification based on the drive belt 42 disablement and at least one additional condition, e.g., in some embodiments the dryer appliance 10 may not provide any notification based on the drive belt 42 disablement alone in the absence of at least one additional condition. The additional condition may be indicative of a potential for additional or further unintended events resulting from or in conjunction with the drive belt 42 disablement. The dryer appliance 10, and in particular the controller 56, may further be configured to modify an operation of the dryer appliance 10 when both the drive belt 42 disablement and the additional condition are detected.

A disabling of drive belt 42 may occur at any time, but is more likely to occur when the dryer appliance 10 is running or shortly after the end of a dryer cycle. Thus, in some embodiments, the additional condition may include that the dryer appliance 10 operating at the time the disablement occurred or that the disablement occurred shortly after the end of a dryer cycle. In instances where a drive belt disablement occurs while the dryer appliance 10 is operating, additional unintended events may occur. For example, if the motor 31 continues to rotate the pulley 50 while the belt 42 is misaligned, physical damage to the drum 26 and/or cabinet 12 may occur, e.g., as a result of the misaligned belt 42 impacting portions of the drum 26 and/or cabinet 12 with which it is not intended to interact. Thus, in some example embodiments wherein the additional condition is that the dryer appliance 10 was operating at the time of the disablement of the drive belt 42, modifying the operation of the dryer appliance 10 may include deactivating the dryer appliance 10, such as by deactivating the motor 31. In particular embodiments, determining that the dryer appliance 10 was operating at the time of the drive belt 42 disablement may include determining that the rotatable drum 26 within the dryer 10 was rotating at the time of the drive belt 42 disablement. Additionally or in the alternative, it may be advantageous in some example embodiments to modify the operation of the dryer appliance 10 by deactivating the heating assembly 40.

As another example, if the drive belt 42 breaks and the drum 26 therefore does not rotate, thermal energy may build up within the chamber 25 and/or the pressure within the chamber 25 may change, which can affect the operation of door 33. Thus, a door switch which indicates the condition of the door 33, e.g., whether the door 33 is an open condition or a closed condition may be in operative communication with the controller 56. For example, the door switch may be configured to send a signal to the controller 56, the signal indicative of the open position of the door 33. In some embodiments, the additional condition may include an open condition of the door 33 of the dryer appliance 10, e.g., that the door 33 is in the open position.

In yet another example embodiment, the controller 56 may be configured to activate air handler 48 in response to the detected drive belt 42 disablement and at least one additional condition. For instance, when the drive belt 42 disablement occurs while laundry is contained in the chamber 25 and the laundry is not yet dry, activating air handler 48 may advantageously provide ventilation to promote air-drying the laundry with ambient temperature air and/or to prevent odor problems, e.g., due to mildew growth on the laundry. In other cases, activating air handler 48 may advantageously promote or maintain a pressure balance between the chamber 25 and the ambient environment outside of the dryer appliance 10.

In some exemplary embodiments, detecting the additional condition may include determining that a dryer cycle was interrupted prior to the belt disablement and the interrupted dryer cycle was the most recent dryer cycle prior to the time of the belt disablement. In some cases, another unintended event may occur at about the same time as drive belt 42 disablement, or some time before the disablement of the drive belt 42. In such cases, the other unintended event may cause a dryer cycle to be interrupted prior to the drive belt disablement. Thus, disablement of the drive belt 42 may occur when the dryer appliance 10 is not operating but within a predetermined time range either before or after the interrupted dryer cycle, in which case the conditions within the dryer appliance 10, and in particular within the chamber 25 thereof, may be the same as or similar to instances wherein the dryer appliance 10 was operating when the drive belt 42 disablement occurred. Therefore, the dryer appliance 10 may be configured to provide a user notification and modify operation of the dryer appliance 10 upon detecting a drive belt 42 disablement and determining that the most recent dryer cycle prior to the detected disablement was interrupted.

In other embodiments, the additional condition may also or instead include conditions independent of whether or not the dryer appliance 10 was operating at or about the time the disablement occurred. For example, in some exemplary embodiments, the additional condition may include a time of day threshold and/or a predetermined time range. In such embodiments, the dryer appliance 10 may include a real-time clock in operative communication with the controller 56. The controller 56 may be operable to retrieve the time of day from the real-time clock, or other means of retrieving accurate time such as via an Internet clock accessed via network device 100. For example, the dryer appliance 10 and/or controller 56 may be configured to provide the notification to the user when the drive belt 42 disablement occurs during a time of day when the user is likely to be not at home or asleep. In some exemplary embodiments, the controller 56 may be configured to provide the notification to the user via a remote user interface device, such as a cell phone, smart phone, smart watch, etc., when disablement of the drive belt 42 is detected during a predetermined time range when the user is not likely to be home. Such time range when the user is not likely to be home may be based on the user's work schedule or other schedule which may, e.g., be manually entered by the user either via a user interface on the dryer appliance 10 itself, such as on cabinet backsplash 71, or via a remote user interface, such as an application on a smart phone. Additionally or in the alternative, the time of day threshold may be built-in, e.g., the dryer appliance may be configured to provide the notification to the user when disablement of the drive belt 42 is detected during a time range when the user is likely to be asleep without the user needing to manually enter such time range.

In other embodiments, the controller 56 may be operable to receive a signal from the remote user interface device, the signal indicative that the user is not at home or asleep. For example, the remote user interface device may include location tracking, such as via GPS or cell network triangulation, and the remote user interface device may be operable to send the signal indicative that the user is not at home to the controller 56 when the location tracking determines that the user is not at home. As another example, the remote user interface device may be operable to send a signal indicating that the user is asleep when the remote user device is in a charging mode with no user interaction. In such embodiments, the controller 56 may be operable to receive the signal from the remote user interface device, the signal indicating that the user is not at home or asleep, and to provide the user notification when the signal is received and a disablement of the drive belt 42 is detected.

In some exemplary embodiments, the dryer appliance 10 may include one or more temperature sensors, such as inlet temperature sensor 43 and/or outlet temperature sensor 47 (FIG. 2), and exemplary methods may include sensing a temperature within the dryer appliance 10, such as a temperature in the chamber 25 and/or duct 52 of the dryer appliance 10. Further, in such embodiments, the additional condition may include an increase in the sensed temperature within a predetermined time range before or after detecting the disablement of the drive belt 42 of the dryer appliance 10. For example, the controller 56 may be configured to monitor the temperature over time, and the additional condition may include a predetermined total increase in temperature within the predetermined time range before or after detecting the drive belt 42 disablement, a rate of increase of the sensed temperature before or after the drive belt 42 is disabled, and/or a maximum temperature before or after the drive belt 42 disablement.

In various embodiments, providing the notification to the user may include providing a graphic or written notification and/or an audible notification. Such notifications, whether written, audible, or both, may be delivered via the dryer appliance 10, e.g., the user interface thereof, and/or a remote user interface on a remote user interface. Various combinations, up to and including both a written and an audible notification on both the dryer appliance user interface and the remote user interface are possible. In various exemplary embodiments, the notification may be a written notification, e.g., one or more text messages. Such written notifications may include, e.g., a text message delivered via email or SMS to a cellphone, tablet computer, smartphone, smart watch, desktop computer, or any other suitable communication device. The text message(s) may also be delivered via the internet, a home network, e.g., intranet, or any other suitable network. Further, such written notifications may be delivered via a dedicated computer program such as a smartphone application or "app." Additionally, written notifications may also include displaying the text message(s) on a display of the dryer appliance 10, as well as or instead of on a remote device. It is understood that any combination of such messages may be provided, e.g., some or all of an email, an SMS message, and a display on the appliance 10 in various combinations may be provided.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of mitigating an unintended circumstance involving a dryer appliance, the method comprising:

detecting disablement of a drive belt of the dryer appliance;

detecting an additional condition by determining that a dryer cycle was interrupted prior to the drive belt disablement and the interrupted dryer cycle was the most recent dryer cycle prior to the time of the drive belt being disabled;

providing a notification to a user when both the drive belt disablement and the additional condition are detected; and modifying an operation of the dryer appliance when both the drive belt disablement and the additional condition are detected.

2. The method of claim 1, the dryer appliance further comprising an air handler in fluid communication with a drum of the dryer appliance, wherein modifying the operation of the dryer appliance comprises modifying the operation of the air handler.

3. The method of claim 1, wherein detecting the additional condition further comprises determining that a rotatable drum within the dryer appliance was rotating at the time of the drive belt disablement.

4. The method of claim 1, wherein detecting the additional condition further comprises detecting an open condition of a door of the dryer appliance.

5. The method of claim 1, wherein detecting the additional condition further comprises retrieving a time of day, and determining that the time of day falls within a predetermined range.

6. The method of claim 1, further comprising sensing a temperature within the dryer appliance, and wherein detecting the additional condition further comprises detecting an increase in the dryer temperature after detecting the disablement of the drive belt of the dryer appliance.

7. The method of claim 1, further comprising connecting to a communications network, and wherein detecting the additional condition further comprises detecting that a communications device is not connected to the communications network, the communications device being separate from the dryer appliance.

8. The method of claim 1, wherein providing the notification to the user comprises providing a written notification.

9. The method of claim 1, wherein providing the notification to the user comprises providing an audible notification.

10. A dryer appliance comprising:

a cabinet;

a drum rotationally mounted within the cabinet, the drum defining a chamber for the receipt of clothes for drying;

a heating assembly in thermal communication with the chamber defined by the drum;

an air handler in fluid communication with the chamber defined by the drum;

a motor;

a drive belt connected to the motor and the drum, the drive belt configured to transfer rotational motion from the motor to the drum; and a controller in operative communication with the heating assembly and the motor, the controller operable to detect a drive belt disablement and to detect an additional condition by determining that a dryer cycle was interrupted prior to the drive belt disablement and that the interrupted dryer cycle was the most recent dryer cycle prior to the time of the belt disablement, the controller further operable to modify an operation of the dryer appliance and provide a notification to a user when both the drive belt disablement and the additional condition are detected.

11. The dryer appliance of claim 10, further comprising a belt switch in operative communication with the controller, the belt switch configured to send a signal to the controller when the drive belt disablement occurs.

12. The dryer appliance of claim 10, further comprising an optical sensor in operative communication with the controller, the optical sensor configured to send a signal to the controller when the drive belt disablement occurs.

13. The dryer appliance of claim 10, further comprising a door positioned on the cabinet, the door movable between an open position for access to the chamber defined in the drum and a closed position for sealingly enclosing the chamber defined in the drum, and a door switch in operative communication with the controller, the door switch operable to send a signal to the controller, the signal indicative of the open position of the door, and wherein detecting the additional condition further comprises detecting that the door is in the open position.

14. The dryer appliance of claim 10, further comprising a real-time clock in operative communication with the controller, and wherein the controller is operable to receive a signal from the real-time clock, the signal indicative of a time of day, and the controller is further operable to detect the additional condition by determining that the time of day falls within a predetermined range.

15. The dryer appliance of claim 10, further comprising a temperature sensor in operative communication with the controller and wherein the controller is further operable to detect the additional condition by detecting a temperature increase in the dryer appliance after detecting the drive belt disablement.

16. The dryer appliance of claim 10, wherein the controller is further operable to connect to a communications network, and wherein the controller is further operable to detect the additional condition by detecting that a communications device is not connected to the communications network.

17. The dryer appliance of claim 10, wherein the notification to the user comprises a written notification.

* * * * *